United States Patent [19]

Pawlek et al.

[11] Patent Number: 4,595,475

[45] Date of Patent: Jun. 17, 1986

[54] SOLID CATHODE IN A FUSED SALT REDUCTION CELL

[75] Inventors: Rudolf Pawlek; Hans-Anton Meier, both of Sierre, Switzerland

[73] Assignee: Swiss Aluminium Ltd., Chippis, Switzerland

[21] Appl. No.: 509,402

[22] Filed: Jun. 30, 1983

[30] Foreign Application Priority Data

Jul. 9, 1982 [CH] Switzerland ..... 4202/82

[51] Int. Cl.[4] ..... C25C 3/08; C25B 11/03; C25B 11/12; C25B 13/00

[52] U.S. Cl. ..... 204/243 R; 204/279; 204/284; 204/286; 204/290 R; 204/291; 204/294

[58] Field of Search ..... 204/294, 67, 286, 243 R, 204/279, 284, 290 R, 291

[56] References Cited

U.S. PATENT DOCUMENTS

| | | | |
|---|---|---|---|
| 3,554,893 | 1/1971 | De Varda | 204/244 |
| 3,893,899 | 7/1975 | Dell et al. | 204/244 |
| 4,290,874 | 9/1981 | McMonigle et al. | 204/243 R |
| 4,462,886 | 7/1984 | Kugler | 204/243 R |
| 4,504,366 | 3/1985 | Jarrett et al. | 204/286 X |

FOREIGN PATENT DOCUMENTS

| | | | |
|---|---|---|---|
| 91459/82 | 10/1982 | Australia | 204/244 |

*Primary Examiner*—Donald R. Valentine
*Attorney, Agent, or Firm*—Bachman & LaPointe

[57] ABSTRACT

An exchangeable solid cathode such that its average density is less than that of the molten aluminum, as a result of which the said cathode floats projecting into the electrolyte from below. At least three vertical, electrically insulating spacers are attached to the work face of the cathode and, due to the upthrust on the floating cathode, press against the work face of the related anode. The said floating cathode also features stabilizing positioning facilities at the side which insure proper lateral positioning of the cathode.

17 Claims, 3 Drawing Figures

SOLID CATHODE IN A FUSED SALT REDUCTION CELL

BACKGROUND OF THE INVENTION

The present invention relates to an exchangeable solid cathode in a fused salt reduction cell for producing aluminum, in which at least one of the working faces is of a wettable material.

In the fused salt reduction process for producing aluminum from aluminum oxide the latter is dissolved in a fluoride melt comprised for the greater part of cryolite. The cathodically precipitated aluminum collects on the carbon floor of the cell under the fluoride melt, the surface of the molten aluminum forming the actual cathode. Dipping into the electrolyte from above are anodes which in conventional processes are made of amorphous carbon. At the carbon anodes oxygen is formed as a result of the electrolytic decomposition of the aluminum oxide; this oxygen combines with the carbon of the anodes to form $C0_2$ and CO.

The electrolytic process takes place in a temperature range extending from approximately 940° C. to 970° C. In the course of the process the electrolyte becomes deplete in aluminum oxide. At a lower concentration of about 1–2 wt. % aluminum oxide in the electrolyte the anode effect occurs whereby there is an increase in voltage from, for example, 4–5 V to 30 V and higher. Then at the latest the aluminum oxide concentration must be raised by addition of fresh aluminum oxide (alumina). In modern reduction cells the addition of alumina takes place at short intervals via at least one opening which is kept open at all times by means of a chisel.

It is known to employ wettable solid cathodes in the aluminum fused salt reduction process. To that end cathodes made of titanium boride, titanium carbide, pyrolytic graphite, boron carbide and other materials are proposed; likewise mixtures of these, which for example can be sintered, are also employed.

In the case of wettable cathodes the interpolar gap can be reduced from the normal approximately 5 cm by as much as the normal parameters allow e.g. taking into consideration the circulation of the electrolyte in the interpolar gap, the escape of the anode gases without reoxidation by the aluminum and maintaining the pot temperature. Reducing in size of the interpolar gap results in a significant reduction in the energy consumed.

The U.S. Pat. No. 4,243,502 reveals solid cathode of individually exchangeable elements each of which has at least one lead for conducting away the current. In a further development revealed in U.S. Pat. No. 4,376,690 the exchangeable elements are of two parts which are joined mechanically and rigidly together, the said parts being resistant to thermal shock, one part viz., the upper part dipping into the precipitated aluminum from the molten electrolyte, and the other part situated completely in the molten aluminum. The said parts are made of different materials, the upper part at least in the region of the surface is unchanged in that it is made of a material which is wet by aluminum, the lower part or a coating thereon being made of an insulating material which is resistant to attack by the molten aluminum.

The German patent publication DE-OS No. 31 42 686 reveals a solid cathode which can be employed in a cell for producing aluminum by the fused salt reduction process, said cathode featuring in its make up an aluminide of at least one transition metal of the groups IV A, V A, and VI A of the periodic table of elements. This solid cathode comprises essentially a supporting part and a structure which at least in the region of the working surface features open pores and is impregnated with aluminum saturated with a transition metal or transition metals. This open pore structure can be fed continuously from a reservoir of aluminide or aluminides. It was found that a few millimeters thick felt pad of carbon fibers proved to be a particularly advantageous type of open pore structure. According to a special version of the said cathode the density of the cathode can lie between that of the molten aluminum and that of the electrolyte thus causing the solid cathode to float in the electrolyte.

SUMMARY OF THE INVENTION

The object of the present invention is to reduce the number of defects which occur relatively often during the handling of exchangeable solid cathodes, and this such that neither the stabilizing of the said cathode by simple means nor the reduced interpolar distance should be affected in a negative way.

This object is achieved by way of the invention by the provision of an exchangeable solid cathode with an average density which lies below that of the molten aluminum, so that the said cathode projects down into the electrolyte and floats in it, at least three vertical electrically insulating spacers are secured to the work face of the cathode the upward thrust of which causes the said spacers to press against the work face of the corresponding anode, and by the provision of positioning facilities stabilizing the floating cathode at the sides.

BRIEF DESCRIPTION OF THE DRAWINGS

The invention is explained in greater detail in the following with the aid of the drawings which are vertical transverse cross sections through parts of electrolytic reduction cells viz.

DETAILED DESCRIPTION

Figure 1:
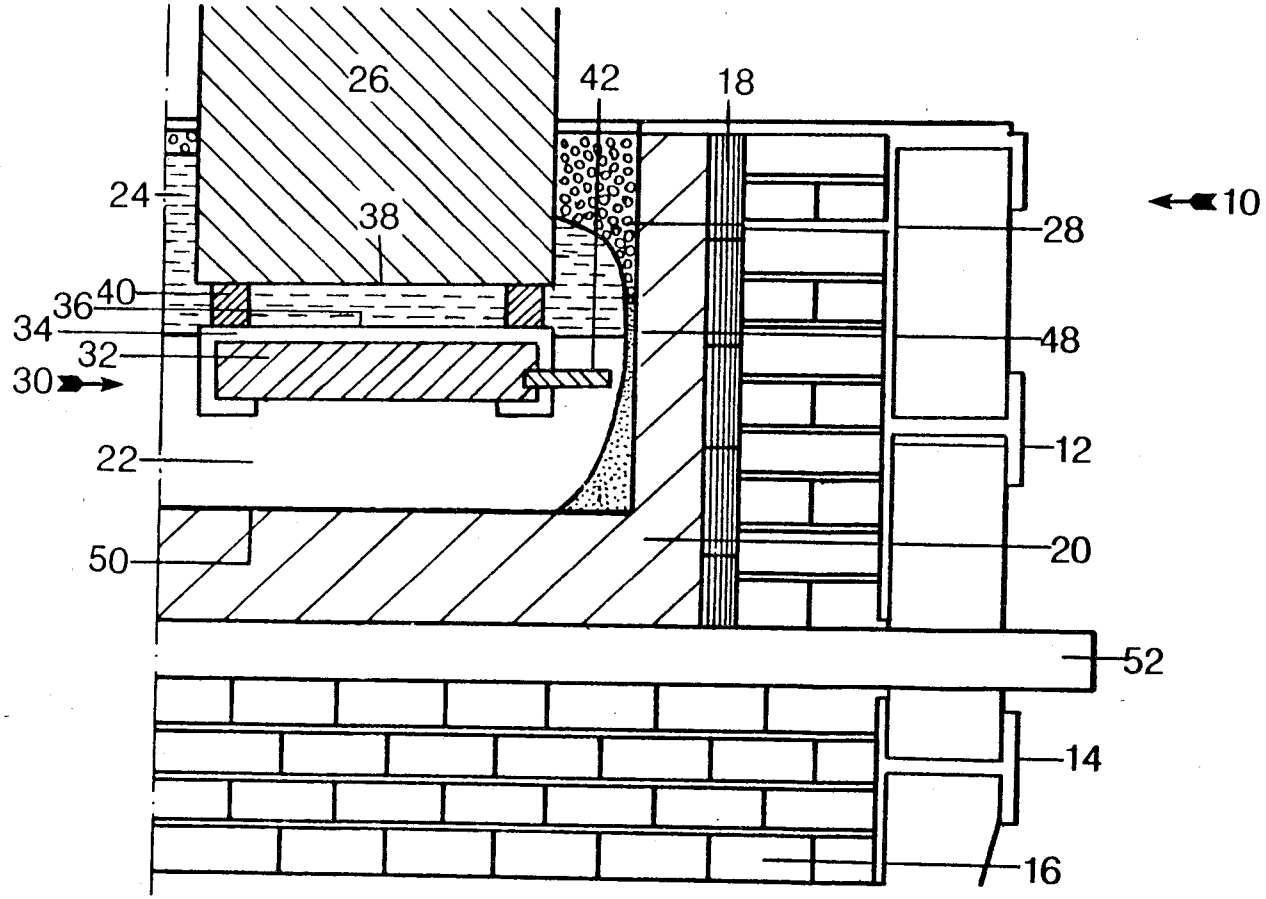
FIG. 1: A solid cathode with positioning facilities at the side and cylindrical spacers.

The work face of a cathode is that surface which faces in the direction of the anode and through which the direct electric current flows. It is on this work face that the aluminum ions are reduced to elemental aluminum. The work faces of the cathodes can therefore usefully be inclined in order that the precipitated aluminum which forms a film on the wettable cathode can run off the said faces.

The work faces of the corresponding anodes which e.g. can be of combustible carbon or non-consumable ceramic oxide, are if desired correspondingly inclined. In this respect it is advantageous to have the inclination such that the surface slopes upwards towards the outside; as a result the oxygen or the $CO_2$ can escape better from the molten electrolyte.

If, due to an error in manipulation, an anode is pressed onto a floating cathode then the latter can deflect away from the anode, thus avoiding any damage.

The average density of the whole cathode lies not only below that of the molten aluminum but preferably also below that of the electrolyte. The density of molten aluminum is around 2.3 g/cm$^3$, that of the electrolyte approximately 2.1 g/cm$^3$. This ensures that the contact surface of the spacers of the floating cathode press with sufficient force on the work face of the corresponding anode.

In order to reach the necessary low density, a foamed rigid material is employed for the supporting body. A coating of material which is wet by liquid aluminum must be provided at least in the region of the work face. Of the known group of materials wet by aluminum for this purpose preference is given to titanium boride, titanium carbide or pyrolitic graphite. The titanium diboride layers are produced for example by chemical vapor deposition (CVD). The foamed rigid support is made preferably of foamed carbon.

The density of the support can, however, also be reduced by providing appropriately dimensioned hollow spaces in a non-foamed material such that the desired apparent density is achieved.

The foamed support which is resistant to attack by electrolyte and molten aluminum can, instead of a compact coating, be provided at least in the region of the work face with an open pore structure which is impregnated with aluminum saturated with one or more transition metals. This structure can be fed continuously from a reservoir of aluminide or aluminides.

The flow of molten aluminum formed by electrolysis can be channeled by providing grooves which are open at both ends on the side of the floating cathode facing the anode. These grooves can have any desired cross-sectional shape; for manufacturing reasons however semi-circular, trapezium or rectangular shapes are preferred.

Furthermore the solid cathode can be penetrated by vertical holes which likewise improve the flow of precipitated metal and the circulation of the electrolyte.

The horizontal dimensions of the cathodes as a rule correspond to those of the related anodes. By providing positioning facilities the cathodes are held in the optimal lateral position so that they can not be displaced by the circulating electrolyte. The positioning facilities can be in the form of vertical elements which project upwards with some room for play at the side faces of the anodes.

Horizontal elements can be directed towards the side ledge of the pot, and can also allow for some play. This second version is, however, less favorable due to the often considerable growth or shrinkage of the side ledge; more room for play must be provided. Positioning facilities between individual cathode elements are usually superfluous.

The positioning facilities are usefully in the form of rods or plates, the latter in particular featuring holes, slits or the like so that circulation of the molten electrolyte is not hindered.

The spacers between the cathode and the anode, which determine the interpolar gap, can in principle have any geometric form. Usefully, however, they are in the form of cylinders, cubes, blocks, or lower parts of cones or pyramids.

The spacers are preferably 2–4 cm high and have an upper limiting surface area of about 1 cm$^2$. These upper limiting faces of the spacers should be as small as possible, at adequate stability, as the work face of the anode is reduced by this amount of area. This is particularly relevant in the case of carbon anodes as the anode is not burnt away at these places. The projections formed however break off relatively quickly, and the operation of the cell is not affected. A constant, average interpolar distance is formed throughout the cell. In the case of non-consumable anodes the problem of formation of such projections does not arise.

Both the spacers and the positioning facilities are made at least in part, but preferably wholly, of insulating material. In practice for example boron nitride, boron carbo-nitride and aluminum nitride have proved themselves for this purpose. These materials are not only electrically insulating but also exhibit adequate mechanical strength.

The spacers and positioning facilities can be secured to the cathodes by means of bolting, push-fit and/or by bonding with a known adhesive substance.

If the spacers are for example of carbon, then the upper limiting surfaces must be of an insulating material, for example a coating deposited by plasma spraying or CVD.

If, with increasing age of the cell, the voltage drop in the floor of the carbon lining increases and the contact resistance between the carbon and the iron cathode bars increases, the problems created by the fixed interpolar gap can be solved by fitting shorter spacers to reduce the amount of heat produced, or making the thermal insulation variable by employing known means. The extra heat produced due to the increase in the cell resistance can for example be drawn off by means of heat pipes or the like.

Figure 2:
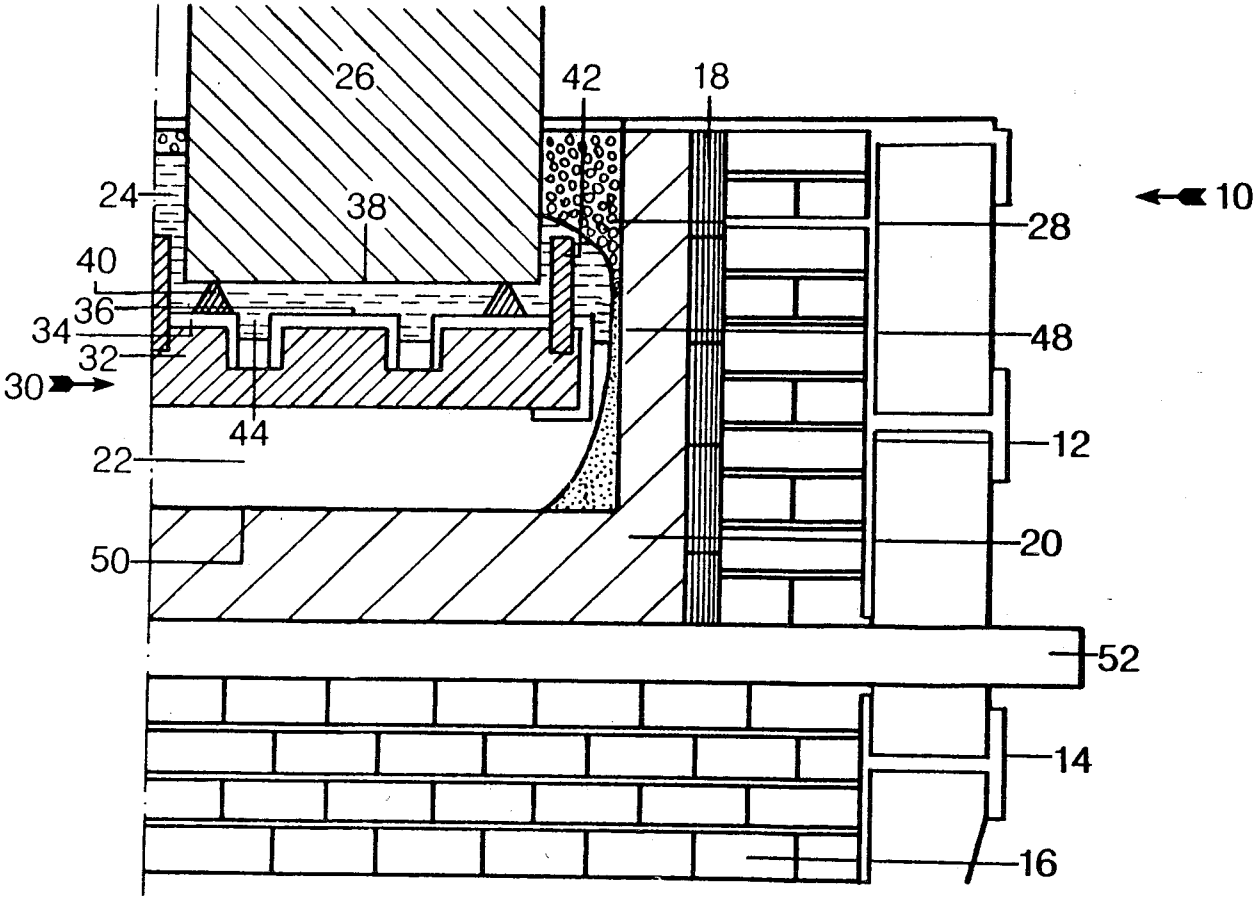
FIG. 2: A solid cathode with vertical positioning facilities and blunt cone-shaped spacers.
Figure 3:
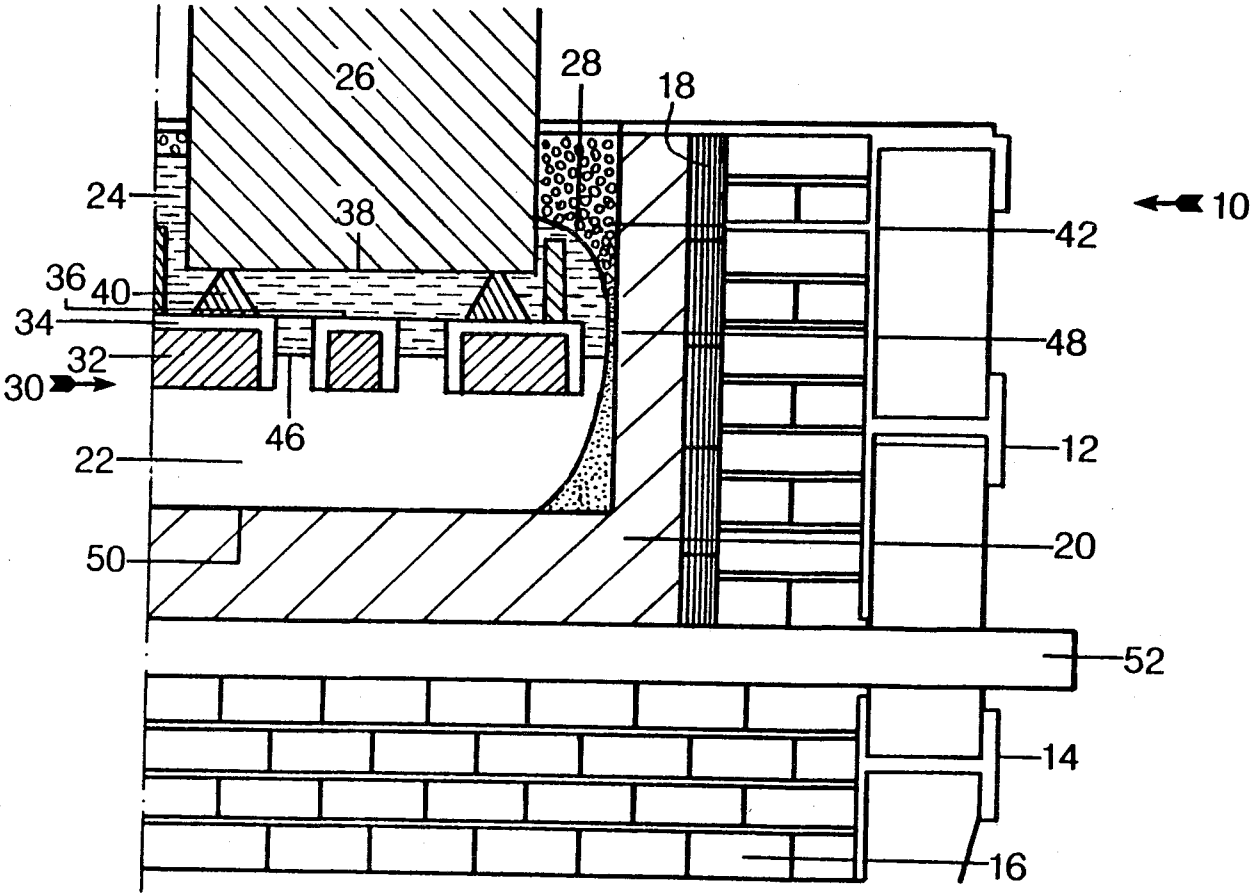
FIG. 3: A solid cathode with vertical positioning facilities and blunt pyramid-shaped spacers.

Referring to the drawing, the electrolytic cells 10 in FIGS. 1–3 feature an outer steel shell 12 which is supported by or on reinforcing sections 14. Bedded into the shell 12 is an insulating layer of insulating bricks 16; the insulation at the side is closed off towards the inside by fireclay bricks 18. The inner carbon lining 20 with side ledge 48 and floor 50 form a trough for the molten aluminum 22 and electrolyte 24. Embedded in the floor 50 are the electrically conductive cathode bars 52. Dipping into the electrolyte 24 are the anodes 26 which are supported on anode rods not shown here. The uppermost part of the electrolyte has solidified to form a solid crust 28. For reasons of clarity the insulating layer of alumina on top of the electrolyte crust is not shown here.

The version according to FIG. 1 shows a solid cathode 30 made up of a porous support 32 and a coating 34 which can be wet by molten aluminum. The work face 36 of the cathode, made of material that can be wet by aluminum has about the same horizontal dimensions as those of the work face 38 of the anode 26. The spacers 40 adhesively fixed to the work face 36 of the cathode 30 are cylindrical in shape and the positioning facilities 42 pushed in and fixed by adhesive at the side are rod-shaped.

The solid cathode 30 shown in FIG. 2 is larger in size on the horizontal plane than the horizontal cross section of the related anode 26. Blunt cone-shaped spacers 40 are adhesively bonded to the work face 36 of the cathode 30. The plate-shaped positioning facilities 42 have been inserted into corresponding openings in the cathode. Provided in the upper part of the cathode 30 are grooves 44 which extend to the side faces of the cathode, are open ended, coated with a wettable coating 34 and are able to accept the precipitated aluminum.

In the version shown in FIG. 3 the horizontal dimension of the solid cathode 30 is likewise larger than that of the anode 26. Blunt pyramid-shaped spacers 40 and rod-shaped positioning facilities 42 are fixed adhesively to the work face 36 of the cathode 30.

Penetrating the cathode 30 are circular holes 46, the faces of which are covered with a wettable coating 34. The cathodically precipitated aluminum collects in the holes 46 up to the level of the aluminum in the cell.

What is claimed is:

1. Exchangeable solid cathode in a cell in particular for the fused salt electrolytic production of aluminum, wherein said cell includes at least an anode, cathode and electrolyte, the improvement which comprising: providing that said anode and cathode have respective work faces facing each other, wherein at least the work face of said cathode is of a wettable material and said cathode has an average density below that of the molten aluminum so that said cathode floats and projects into the electrolyte from below, at least two electrically insulating spacer means attached to the work face of the cathode, said spacer means being pressed against the work face of the related anode due to the upthrust on the cathode and side stabilizing means affixed to said cathode which provide for the lateral positioning of the cathode.

2. Cathode according to claim 1 wherein said cathode has an average density below that of the electrolyte.

3. Cathode according to claim 1 wherein said cathode includes a support means of foamed material which is resistant to the electrolyte and the molten aluminum.

4. Cathode according to claim 3 wherein said cathode includes a coating selected from the group consisting of titanium boride, titanium carbide and pyrolytic graphite at least in the region of the work face.

5. Cathode according to claim 3 wherein said foamed material is foamed carbon.

6. Cathode according to claim 3 wherein said cathode includes an open pore structure which is provided at least in the region of the work face and in impregnated with aluminum saturated with one or more transition metals.

7. Cathode according to claim 1 wherein the cathode work face includes grooves or channels which are open at both ends.

8. Cathode according to claim 1 wherein vertical holes pass through said cathode.

9. Cathode according to claim 1 wherein the spacer means which are attached to the work face of said cathode determine the interpolar gap.

10. Cathode according to claim 9 wherein said spacer means are cylindrical, cubic, block, blunt cone or blunt pyramid in shape.

11. Cathode according to claim 1 wherein a plurality of sapcer means are provided.

12. Cathode according to claim 1 wherein the spacer means are 2–4 cm in height and have an upper contact surface of about 1 $cm^2$.

13. Cathode according to claim 1 wherein the stabilizing means are in the form of vertical or horizontal rods or plates.

14. Cathode according to claim 1 wherein the spacer means and stabilizing means are made of a material selected from the group consisting of boron nitride, boron carbo-nitride and aluminum nitride and are attached to the said cathode by screwing, push-fit or adhesive means.

15. Cathode according to claim 1 including at least two vertical electrically insulating spacer means attached to the work face of the cathode.

16. Cathode according to claim 1 including side stabilizing means affixed to said cathode.

17. An electrolytic cell for the electrolysis of a molten electrolyte having anode and cathode elements, in particular for the production of molten aluminum, said cell having at least one exchangeable solid cathode, the improvement which comprises: providing that said anode and cathode have respective work faces facing each other, wherein at least the work face of said cathode is of a wettable material and said cathode has an average density below that of the molten aluminum so that said cathode floats and projects into the electrolyte from below, at least two electrically insulating spacer means attached to the work face of the cathode, said spacer means being pressed against the work face of the related anode due to the upthrust on the cathode and side stabilizing means affixed to said cathode which provide for the lateral positioning of the cathode.

* * * * *

UNITED STATES PATENT AND TRADEMARK OFFICE

CERTIFICATE OF CORRECTION

PATENT NO. : 4,595,475

DATED : June 17, 1986

INVENTOR(S) : RUDOLF PAWLEK ET AL.

It is certified that error appears in the above-identified patent and that said Letters Patent is hereby corrected as shown below:

Column 5, claim 1, line 9, change "comprising" to read --comprises---.

Column 5, claim 6, line 35, change "in" to read ---is---.

Column 6, claim 11, line 8, change "sapcer" to read ---spacer---.

Signed and Sealed this

Seventh Day of October, 1986

[SEAL]

*Attest:*

DONALD J. QUIGG

*Attesting Officer*

*Commissioner of Patents and Trademarks*